United States Patent [19]

Loberger et al.

[11] Patent Number: 5,062,790

[45] Date of Patent: Nov. 5, 1991

[54] BURNER SOUND REDUCTION ENCLOSURE

[75] Inventors: Gregory C. Loberger, Dallas, Tex.; Jay L. Slind, Superior, Wis.

[73] Assignee: Lennox Industries Inc., Carrollton, Tex.

[21] Appl. No.: 490,926

[22] Filed: Mar. 9, 1990

[51] Int. Cl.[5] ..... F23D 11/40

[52] U.S. Cl. ..... 431/114; 126/112; 126/99 A; 165/135; 181/229

[58] Field of Search ..... 126/112, 110 C, 110 R, 126/110 A, 116 R, 116 A, 91 A, 99 A; 431/114, 159; 165/135; 181/229

[56] References Cited

U.S. PATENT DOCUMENTS

| | | | |
|---|---|---|---|
| 2,150,782 | 3/1939 | Vollmer | 431/114 |
| 4,417,868 | 11/1983 | Putnam | 431/114 |
| 4,476,850 | 10/1984 | Pickering | 431/114 |

FOREIGN PATENT DOCUMENTS

| | | | |
|---|---|---|---|
| 2048642 | 4/1972 | Fed. Rep. of Germany | 431/114 |
| 1274414 | 5/1972 | United Kingdom | 431/114 |

*Primary Examiner*—James C. Yeung

*Attorney, Agent, or Firm*—Allegretti & Witcoff, Ltd.

[57] ABSTRACT

A furnace having a housing, a combustion chamber within the housing, and a burner associated with the combustion chamber is provided with a sound enclosure housing including a muffler portion. The muffler portion comprises an elongated serpentine passage having an air opening at one end.

6 Claims, 1 Drawing Sheet

Fig.1
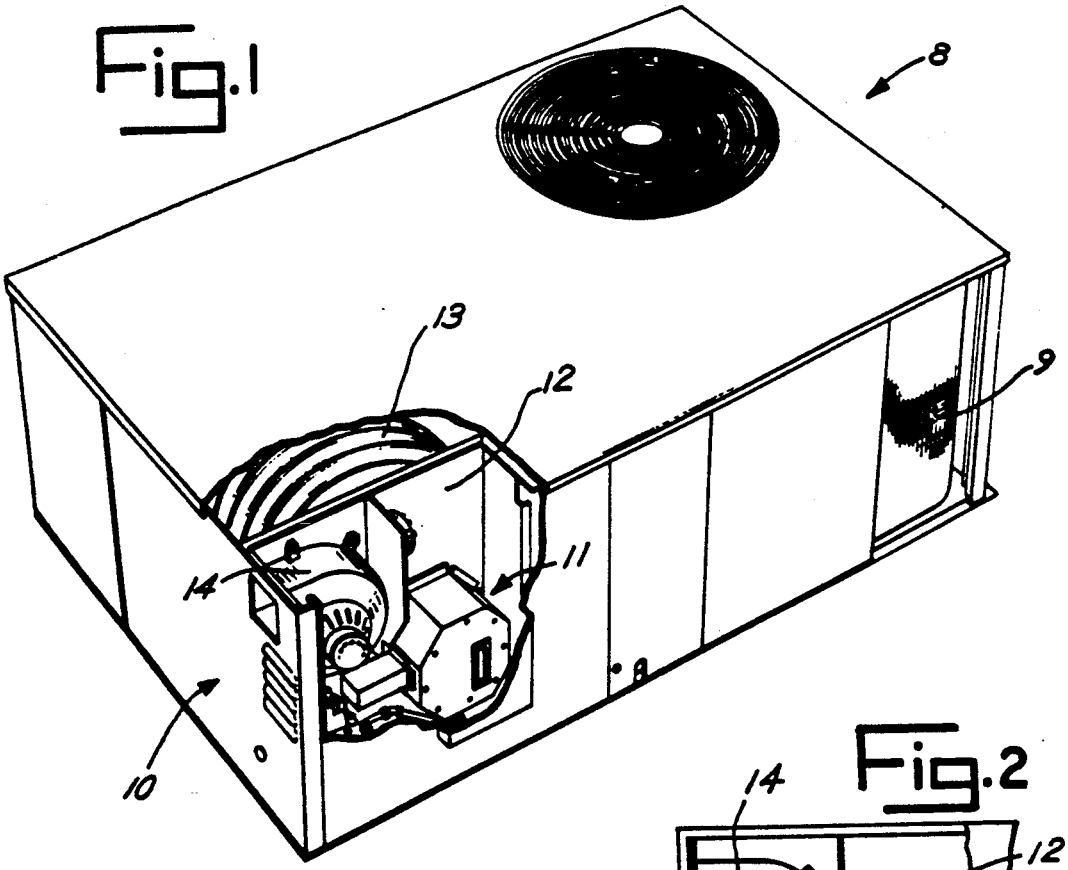
Fig.2
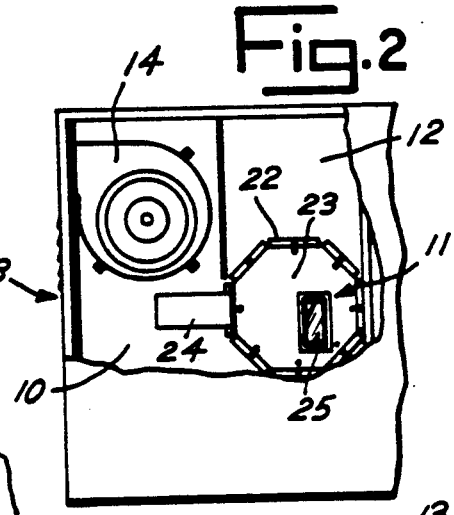
Fig.3
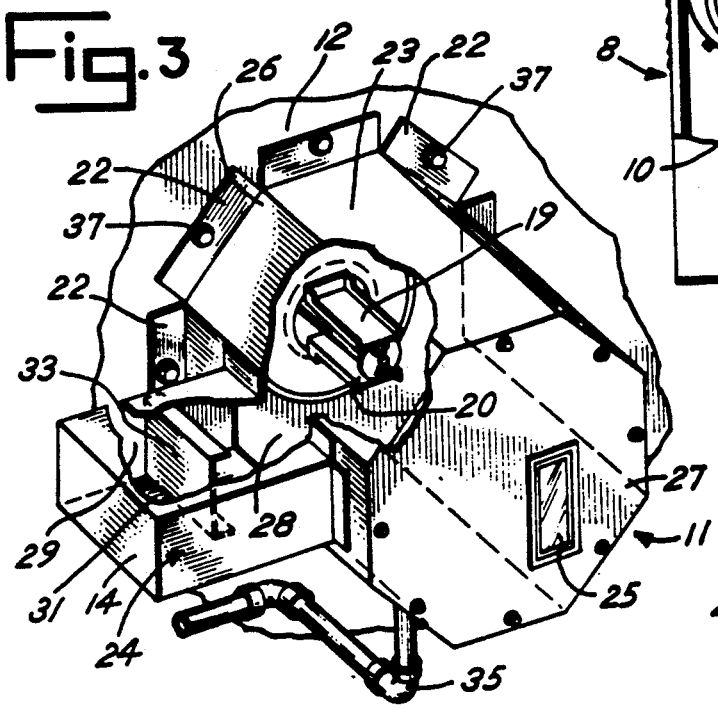
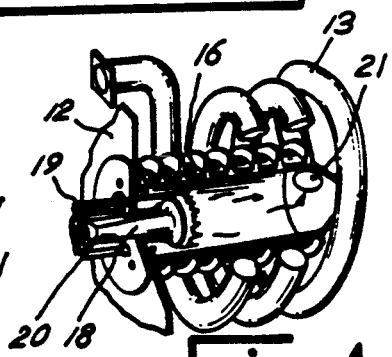
Fig.4

BURNER SOUND REDUCTION ENCLOSURE

BACKGROUND OF THE INVENTION

Field of the Invention

The present invention relates to furnaces and particularly to a sound reduction enclosure attached to a furnace which reduces the sound of the combustion process taking place inside of the furance.

Room air may be heated by passing a forced draft over the combustion system of a furnace and then returning the air in heated condition to the room. Typically, a combustible fuel gas and combustion air are admitted into a combustion chamber of a furnace. In a design for which the invention is particularly adapted, the furnace includes a compact generally cylindrical cast combustion chamber having a single port inshot target burner disposed therein. The gas-air mixture is ignited within the combustion chamber, producing a turbulent flame with resultant generation of heat. The combustion products pass through a heat exchanger and are vented to the atmosphere. The agitation of the burner flame, which is necessary to satisfy combustion and performance requirements, generates noise at a level which is undesirable for commercial or residential applications.

Considerable effort was given to muffling the sound to acceptable levels for consumer acceptance. Criteria met by the invention were (1) the sound is effectively muffled without interfering with the air and gas mixing in a manner that would adversely affect burner performance and (2) the sound muffling arrangement effectively contains noise emission from the combustion chamber and avoids harmonic/pure tone resonance.

SUMMARY OF THE INVENTION

A sound reduction enclosure according to the present invention is for use with a furnace having a housing, a cast combustion chamber within the housing, a heat exchanger associated with the combustion chamber for heating air, a single port inshot target burner associated with the combustion chamber and adapted to communicate with a source of fuel and means for supplying air to the combustion chamber. The fuel and air are ignited in the combustion chamber creating a turbulent flame that generates noise. The sound reduction enclosure provides a serpentine flow path for the air to preclude direct sound emission from within the enclosure. Also, the sound reduction enclosure is constructed and arranged to redirect the sound emission away from the outer furnace panels and toward the source. The air inlet opening is set to a minimum to provide required efficiency and further inhibit the sound transmission. The sound reduction enclosure is constructed and arranged so as to avoid harmonic/pure tone resonance.

An object of the present invention is to provide a useful enclosure that reduces the sound associated with the combustion process inside of a furnace.

Another object of the present invention is to provide an enclosure that reduces the sound associated with the combustion process and does not interfere with the mixture of air and gas in a manner that would adversely affect burner performance.

An additional object of the present invention is to provide an enclosure that reduces the sound associated with the combustion process and avoids harmonic/pure tone resonance due to the enclosure.

The foregoing and other objects, features, and advantages of the present invention will become more apparent from the following detailed description of the present invention when taken in conjunction with the accompanying drawings.

BRIEF DESCRIPTION OF THE DRAWINGS

The attached drawings illustrate a presently preferred embodiment of the present invention, wherein like numerals refer to like elements in the various views and wherein;

FIG. 1 is a perspective view of one application of the present invention and shows a combination furnace and air conditioner with a portion of the furnace cut away to show the sound reduction enclosure of the present invention;

FIG. 2 is a cut-away perspective showing of the combustion chamber showing the single port inshot burner therein and the heat exchanger leading from the combustion chamber;

FIG. 3 is a rear view of the furnace with a portion of the housing cut away to show the sound reduction enclosure; and FIG. 4 is a perspective view of a sound reduction enclosure with a portion cut away to better show the enlongated serpentine air passage.

DESCRIPTION OF THE PREFERRED EMBODIMENT

Referring to FIG. 1, there is shown an air conditioning and heating device 8 comprising an air conditioner 9 and a furnace 10 embodying the sound reduction enclosure 11 of the present invention. The furnace 10 includes a housing 12 within which is disposed a combustion chamber affixed to a tubular heat exchanger 13. A fan or induced draft blower 14 is affixed to an upright wall of the housing 12 for drawing combustion products from the heat exchanger and discharging them via a vent (not shown) to the atmosphere. A burner is provided within the combustion chamber. It will be understood that fuel and air will be burned in the combustion chamber and the process will create noise, which the sound reduction enclosure 11 is adapted to confine and reduce in an effective fashion.

Turning to FIG. 2, there is better shown the arrangement of combustion chamber, burner and heat exchanger. The combustion chamber 16 is shown as an elongated cylinder. It is preferably a cast steel member. The left end as seen in FIG. 2 is open to receive the burner 18. The right end has an opening 21 that communicates with the coil heat exchanger 13.

The burner 18 is preferably a single shot inshot burner that is affixed to the wall 12 of the furnace and extends into the combustion chamber 16 for burning the air in a turbulent manner. The turbulent action of combustion causes the noise that is to be muffled by the sound reduction enclosure 11 of the present invention.

As shown in FIGS. 2 and 3, the burner 18 is fixed in position on the wall of the housing 12 by upper and lower support brackets 19, 20.

Referring to FIGS. 3 and 4, the sound reduction enclosure 11 includes a central portion 23 and a muffler portion 24. The central portion 23 contains an open end 26 and a closed end 27. Flanges 22 are formed at generally a right angle to the central portion 23. The flanges 22 have openings therein. Fastening means, such as bolts 37, secure the flanges of the central portion 23 to the upright wall of housing 12 and thereby secure the sound reduction enclosure in place. In the preferred embodiment shown in FIGS. 3 and 4, an eyeglass or sight means 25 is built into the closed end 27 of the central portion 23 to allow examination of the interior of the central portion 23 during operation of the furnace. An elongated serpentine air passage 31 is provided within the muffler portion 24. One end of the air passage 31 communicates with the interior of the central portion 23. The other end of the air passage 31 communicates with atmospheric air through an additional opening 29 in muffle portion 24. Baffle 33 is provided in the air passage within the muffler portion 24.

A fuel supply means 35 is provided for supplying a source of fuel to the burner 18 for burning in the combustion chamber 16. The fuel supply means 35 is connected to the single port in burner 18. Air for combustion is supplied through opening 29 in the muffler portion 24. Air from the muffler portion 24 passes through opening 28 into the central portion 23 and then into the combustion chamber 16 where it mixes with the fuel and is burned. Primary air enters the rear of the burner and secondary air passes through an opening or openings about the burner.

One source of noise emanating within the combustion chamber 16 is the opening in the housing 12 that surrounds the burner 18. The amount of noise emanating directly from the combustion chamber 16 is related to the volumetric flow rate of gas being burned and accompanying air required for combustion provided through opening 29. Reducing the area of opening 28 reduces the amount of notice transmitted outside the furnace. Opening 28 must be large enough to allow introduction of sufficient air for complete combustion. This air is drawn into the combustion chamber 16 by the negative pressure imposed therein by action of the induced draft blower 14. Additionally, the serpentine design of the elongated passageway 29 helps to substantially eliminate direct sound emission from the enclosure opening. The design is such that sound emission is reduced to an acceptable level, while not restricting inlet air to an insuficient level to cause incomplete combustion of introduced gas.

FIG. 4 illustrates the preferred embodiment where air for combustion passes from the opening 29 in the muffler portion 34 through a serpentine passageway 31 and into the central portion through the opening 28. Fuel supplied by supply means 35 is mixed with air supplied through the muffler portion 24 in the combustion chamber 16, where the mixture is ignited. The turbulent burning within the combustion chamber 16 produces sound pressure waves in the air within the combustion chamber 16. The central portion 23 of the sound reduction enclosure 11 obstructs the sound pressure waves emanating from the combustion chamber 16, reducing noise emission due to combustion. The portion of sound pressure waves which pass through the opening 28 and into the muffler portion 24 will be further reduced by the pressure differential existing between the sound source area in combustion chamber 16 and inlet opening 29 at ambient pressure, as well as by the muffler enclosure walls 24.

The preferred embodiment of sound reduction enclosure shown in FIGS. 1, 3 and 4 has a central portion 23 in the general shape of an octagon. During experimentation, a central portion of cylindrical shape was tested but produced harmonic/pure tone resonance and was discarded. The sound reduction enclosure 11 using a central portion 23 of octagonal shape did not produce resonance. The tests were conducted in a reverberation sound room measuring one-third octave band sound pressure levels at frequencies from 25–10,000 Hz. Baseline tests of a furnace not equipped with a sound reduction enclosure revealed high sound pressure levels in the 63–250 Hz frequency range. While frequency bands above and below this range showed little or no change when the sound reduction enclosure was attached, reductions of 7–16 db were obtained in the 63–250 Hz range. Such a reduction is considered significant since the human ear can detect sound differences as small as 3 dB, which is also a 50% reduction in sound level. When the sound reduction enclosure was used on the furnace design, the sound levels were found to be acceptable for the application.

Although a presently preferred embodiment of the present invention has been described and illustrated in detail, it is clearly understood that the same is by way of illustration and example only and is not to be taken by way of limitation. The spirit and scope of the present invention are limited only by the terms of the appended claims and their proper equivalents.

What is claimed:

1. For use with a furnace having an outer housing, a combustion chamber within said housing, a burner associated with said combustion chamber and adapted to communicate with a source of fuel, means for supplying air to the combustion chamber, said fuel and said air being ignited in the combustion chamber, the improvement characterized by a sound reduction enclosure means secured within said housing, said sound reduction enclosure means including a muffler portion defining an elongated air passage having an air opening at one end and a baffle in said elongated air passage, said sound reduction enclosure means comprising a generally octagon-shaped enclosure that contains the noise emission from the combustion chamber and avoids harmonic/pure tone resonance, said air opening to the muffler portion being restricted and the elongated air passage being serpentine to eliminate direct sound emission from said air opening, said muffler portion being constructed and arranged so as to redirect sound emission toward the source, the sound reduction being on the order of 7–16 db in the 63–250 Hz range as compared to the same furnace without the sound reduction enclosure.

2. A furnace as in claim 1 including a sight means disposed in the sound reduction enclosure means for enabling a user to observe the interior of the sound reduction enclosure means.

3. A furnace as in claim 2 wherein the sight means is a sight glass.

4. A furnace as in claim 1 wherein the combustion chamber is formed within a cast housing and an inshot target burner is disposed within the combustion chamber, the ignition of the fuel and air creating a turbulent flame which generates the noise to be muffled.

5. A furnace having an outer housing, a cast combustion chamber within said housing, at least one inshot target burner associated with said combustion chamber and adapted to communicate with a source of fuel, means for supplying air to the combustion chamber, said fuel and said air being ignited in the combustion chamber, the ignition of the fuel and air creating a turbulent flame which generates noise to be muffled, a sound reduction enclosure means secured within said housing, said sound reduction enclosure means including a muffler portion defining an elongated air passage having an air opening at one end, said sound reduction enclosure means comprising a generally octagon-shaped enclosure that contains the noise emission from the combustion and avoids harmonic/pure tone resonance, said air opening to the muffler portion being restricted and the elongated air passage being serpentine to eliminate direct sound emission from said air opening said muffler portion being constructed and arranged so as to redirect sound emission toward the source, the sound being effectively muffled without interfering with the air and gas mixing in a manner that would adversely affect performance of the inshot target burner, the sound reduction being on the order of 7–16 db in the 63–250 Hz range as compared to the same furnace without the sound reduction enclosure means.

6. A furnace having an outer housing, a cast combustion chamber within said housing, at least one inshot target burner associated with said combustion chamber and adapted to communicate with a source of fuel, means for supplying air to the combustion chamber, said fuel and said air being ignited in the combustion chamber, the ignition of the fuel and air creating a turbulent flame which generates noise to be muffled, a sound reduction enclosure means secured within said housing, said sound reduction enclosure means including a muffler portion defining an elongated air passage having an air opening at one end, said sound reduction enclosure means comprising a generally octagon-shaped enclosure that contains the noise emission from the combustion and avoids harmonic/pure tone resonance, said air opening to the muffler portion being restricted and the elongated air passage being serpentine to eliminate direct sound emission from said air opening, said muffler portion being constructed and arranged so as to redirect sound emission toward the source, the sound being effectively muffled without interfering with the air and gas mixing in a manner that would adversely affect performance of the inshot target burner.

* * * * *